United States Patent [19]

Herrick

[11] 4,001,932

[45] Jan. 11, 1977

[54] ROTARY SHAVER WITH SHEAR PLATE ROTATION PREVENTING MEANS

[75] Inventor: Wallace D. Herrick, Grand Rapids, Mich.

[73] Assignee: Bissell Inc., Grand Rapids, Mich.

[22] Filed: Nov. 17, 1972

[21] Appl. No.: 307,517

Related U.S. Application Data

[63] Continuation-in-part of Ser. No. 271,798, July 14, 1972.

[52] U.S. Cl. ..... 30/43.5

[51] Int. Cl.[2] ..... B26B 19/16

[58] Field of Search ..... 30/43.4, 43.5, 43.6, 30/346.51

[56] References Cited

UNITED STATES PATENTS

| | | | |
|---|---|---|---|
| 2,900,720 | 8/1959 | Starre | 30/43.5 |
| 3,081,541 | 3/1963 | Vaes | 30/43.6 |
| 3,694,915 | 10/1972 | Beusink | 30/43.5 X |
| 3,715,803 | 2/1973 | Tyler | 30/43.5 |

*Primary Examiner*—Gary L. Smith

*Attorney, Agent, or Firm*—Andrus, Sceales, Starke & Sawall

[57] ABSTRACT

A dry rotary shaver has a floating shear plate disposed within a head opening which provides an outer stop, and a rigid stop member which limits inward shear plate movement. The stop member is provided with one or more outwardly extending rigid posts of fixed length which are received within complimentary notches in the wall of the shear plate.

3 Claims, 4 Drawing Figures

ROTARY SHAVER WITH SHEAR PLATE ROTATION PREVENTING MEANS

This application is a continuation-in-part of co-pending U.S. application Ser. No. 271,798, filed July 14, 1972 by the present inventor and Robert A. Yonkers, entitled Dry Shaver With Floating Peripherally Supported Shear Plate, and assigned to a common assignee.

BACKGROUND AND SUMMARY OF THE INVENTION

This invention relates to a rotary dry shaver of floating shear plate design, and wherein a rotary cutting member is disposed beneath the shear plate for removing hairs extending through the plate.

The device of the present invention is a further modification of certain concepts disclosed in the abovementioned co-pending application. In that application, a support is fixed within the shaver head and acts as a retaining means to hold the shear plate and rotary cutting element in place when the shaver head is removed from the shaver housing. In the embodiments shown therein, the support includes a resilient spring which engages the shear plate periphery, and in several embodiments shown the support includes a stop to limit the inward floating movement of the shear plate. Furthermore, there is disclosed therein the concept of an interlock between the retaining means and the shear plate to prevent rotation of the latter without interfering with its tilting action. In the specific embodiments shown there, the interlock comprises a lug on the spring which cooperatively engages a notch in the shear plate periphery.

In some instances, it has been found desirable to eliminate the spring portion of the retainer-support, while still retaining the interlock between the latter and the floating shear plate, as well as retaining the inner stop.

Broadly in accordance with the present invention, the shear plate and a rigid stop member are provided with non-yieldable projection means and recess means which cooperatively interlock to hold the floating shear plate against rotary movement. More specifically, and in the embodiments shown, the stop member is provided with one or more outwardly extending rigid posts of fixed length which are received within complimentary notches in the wall of the shear plate. The posts are long enough to be disposed within the shear plate notches throughout the full range of floating positions of the shear plate.

DESCRIPTION OF THE DRAWING

The accompanying drawing illustrates the best modes presently contemplated by the inventor for carrying out the invention.

In the drawing.

DESCRIPTION OF THE PREFERRED EMBODIMENTS

The concepts of the invention may be utilized in a dry shaver having a single shear plate or any desirable number thereof.

Figure 1:
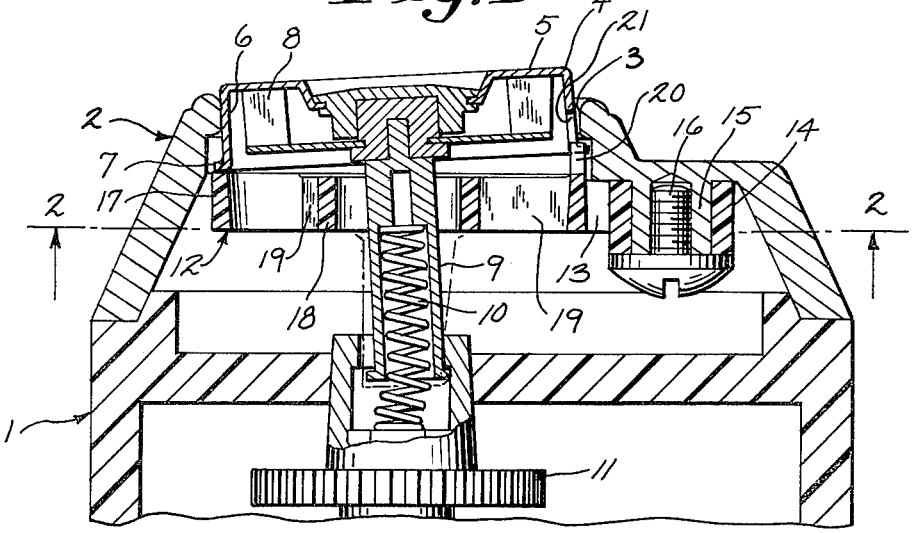
FIG. 1 is a vertical section of a portion of a single head dry rotary shaver constructed in accordance with the invention.
Figure 2:
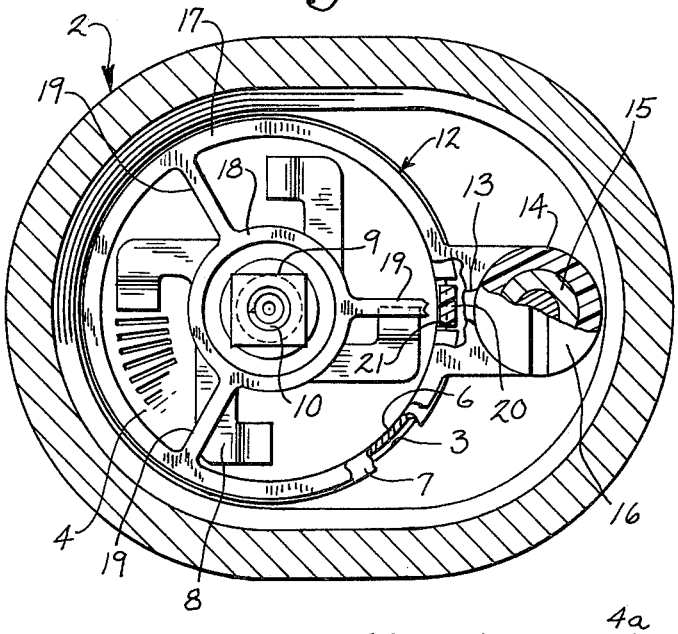
FIG. 2 is a transverse section taken on line 2—2 of FIG. 1.

FIGS. 1 and 2 illustrate one form of the invention as applied to a shaver with one shear plate. As shown therein, the shaver includes a housing 1 having a removable head 2 which is provided with a suitable annular opening 3 therein. Opening 3 is adapted to receive a floating annular relatively rigid shear plate 4 having an outer shaving face 5 which merges with a cylindrical wall 6, which in turn terminates at its inner edge in a peripheral flange 7 of a larger diameter than the opening. Shear plate 4 is installed in opening 3 so that flange 7 is disposed inwardly of the opening whereby the edge portion of the latter acts as an outer stop.

A rotary cutting element or member 8 is mounted on the end of a floating tiltable drive shaft 9 of any suitable well-known type and is biased into central supporting engagement with shear plate 4, as by a spring 10. Spring 10 biases both cutter 8 and shear plate 4 outwardly to a position where flange 7 engages the edge of head 2 around opening 3, which is the normal nonoperating position of the parts. The inner end of shaft 9 is rotationally connected to drive gearing 11 which in turn is connected to the usual shaver motor, not shown.

In accordance with the invention, shear plate 4 cooperates with rigid inner stop means, without the need for a peripheral spring support for the shear plate, and in a manner so that the inner stop means prevents shear plate rotation. For this purpose, a unitary relatively rigid stop member 12 is incorporated within the head. As shown, stop member 12 is preferably of molded plastic and is connected by a web 13 to an annular boss 14 which is mounted on a hub-like member 15 within head 2. A screw 16 threadably extends into hub 15, the head of which fixedly holds boss 14 and stop member 12 in place. Stop member 12 may be of any suitable construction, and in the embodiment shown comprises a transverse generally planular portion having a pair of concentric rings 17, 18 joined by radially extending ribs 19.

Stop member 12 has the additional function of retaining shear plate 4 and cutting member 8 in assembly within the head, even when the head is removed from housing 1.

The invention contemplates the utilization of non-yieldable projection means and recess means which cooperatively interlock to hold the floating shear plate against rotation at any position thereof during shaver operation. For this purpose, and in the embodiment of FIGS. 1 and 2, a rigid locking post 20 is formed as part of support member 12 and extends longitudinally outwardly from outer ring 17 adjacent boss 14. Post 20 is of fixed length and with its outer end extending into and disposed within a complimentary longitudinally extending notch 21 in shear plate wall 6 for longitudinal relative movement therebetween.

Figure 3:
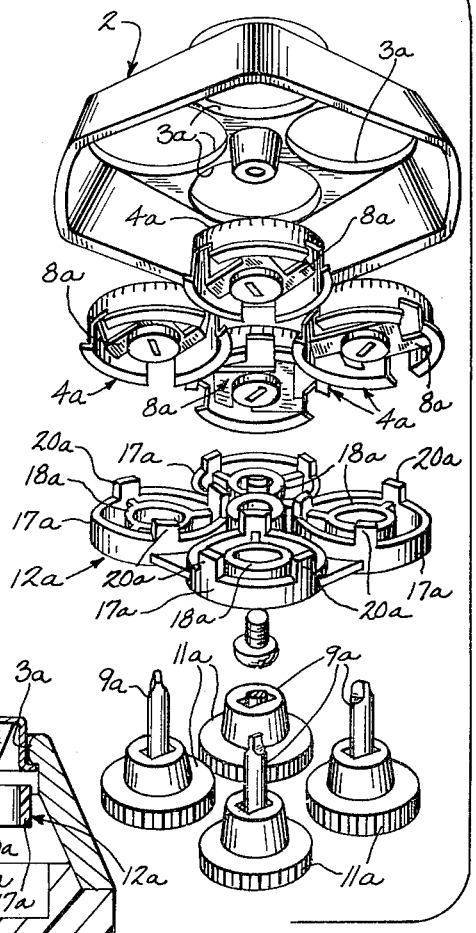
FIG. 3 is an exploded perspective view of a four head shaver incorporating the invention.
Figure 4:
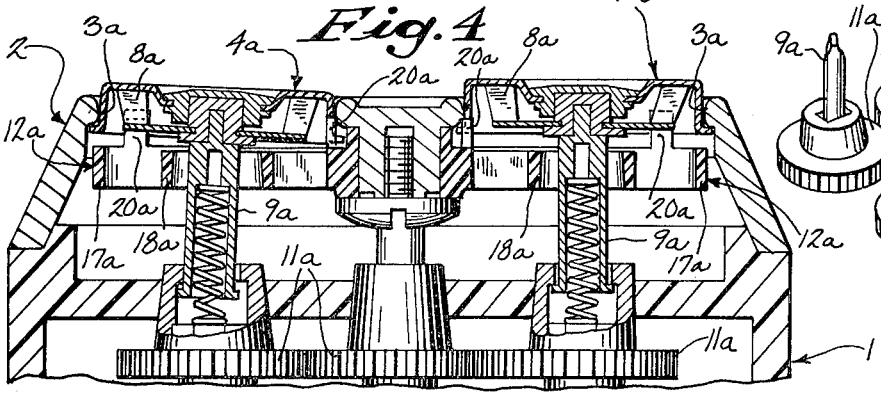
FIG. 4 is a view similar to FIG. 1 of the four head shaver.

FIGS. 3 and 4 illustrate an embodiment of the invention somewhat similar to the previously described embodiment, except that the shaver is adapted to have a multiplicity of shear plates, namely four. As shown, these four shear plates **4*a* are mounted in head openings 3*a*, and each has a cutting member 8*a* mounted on suitably driven individual floating drive shafts 9*a* which are connected to suitable gearing 11*a*. In this embodiment, stop member 12***a* includes four pairs of concentric rings 17*a*, 18*a*, and a plurality of circumferentially spaced locking posts 20*a* extend outwardly from each ring 17*a*. In FIG. 4, one shear plate is shown in normal position, while another plate is shown in tilted position.

It is contemplated that the depth of the shear plate notches relative to the length of the locking posts may be such that the inner shear plate periphery upon inward floating movement, will engage the inner transverse stop member portion before the posts can bottom within the notches, as shown in the embodiment of FIGS. 1 and 2. Alternately, and as shown in the embodiment of FIGS. 3 and 4, the relationship of notch depth to post length may permit the posts to bottom within the notches. In the latter case, the posts themselves provide the inner fixed stop function. In either event, the posts are of such length that they remain disposed within the shear plate notches throughout the full range of floating shear plate positions; i.e. at the inner and outer stop positions and therebetween.

Various modes of carrying out the invention are contemplated as being within the scope of the following claims particularly pointing out and distinctly claiming the subject matter which is regarded as the invention.

I claim:

1. A dry shaver comprising:

a. a shaver housing including a shaving head having at least one opening therein, b. a shear plate disposed within said opening and adapted for tilting relative thereto and with the edge of said opening forming a fixed outer stop therefor, said shear plate including a cylindrical wall, c. a floating rotary cutting element disposed within said shear plate and tiltably supporting the latter, d. a rigid fixed inner shear plate stop member removably secured in said head, e. and cooperative interlocking means on said shear plate and on said fixed stop member to prevent shear plate rotation at any tilted position thereof during rotation of said cutting member, said interlocking means comprising:

1. recess means comprising at least one notch formed in said cylindrical wall, 2. and a fixed projection formed in said rigid stop member and disposed within said notch, said fixed projection comprising a post of fixed length disposed within said notch throughout the full range of floating shear plate positions, f. said stop member including an inner transverse planular portion from which said post extends, g. the length of said post being such that said shear plate will, upon inward floating movement, engage said inner transverse planular portion before said post can bottom within said notch.

2. A dry shaver comprising:

a. a shaver housing including a shaving head having at least one opening therein, b. a shear plate disposed within said opening and adapted for tilting relative thereto and with the edge of said opening forming a fixed outer stop therefor, said shear plate including a cylindrical wall, c. a floating rotary cutting element disposed within said shear plate and tiltably supporting the latter, d. a rigid fixed inner shear plate stop member removably secured in said head, e. and cooperative interlocking means on said shear plate and on said fixed stop member to prevent shear plate rotation at any tilted position thereof during rotation of said cutting member, said interlocking means comprising:

1. recess means comprising at least one notch formed in said cylindrical wall, 2. and a fixed projection formed in said rigid stop member and disposed within said notch, said fixed projection comprising a post of fixed length disposed within said notch throughout the full range of floating shear plate positions, f. said stop member including an inner transverse planular portion from which said post extends, g. the length of said post being such that, upon inward floating shear plate movement, said post will bottom within said notch and constitute the inner stop for said shear plate.

3. A dry shaver comprising:

a. a shaver housing including a shaving head having at least one opening therein, b. a shear plate disposed within said opening and adapted for tilting relative thereto and with the edge of said opening forming a fixed outer stop therefor, said shear plate including a cylindrical wall, c. a floating rotary cutting element disposed within said shear plate and tiltably supporting the latter, d. a rigid fixed inner shear plate stop member removably secured in said head, e. and cooperative interlocking means on said shear plate and on said fixed stop member to prevent shear plate rotation at any tilted position thereof during rotation of said cutting member, said interlocking means comprising:

1. recess means comprising at least one notch formed in said cylindrical wall, 2. and a fixed projection formed in said rigid stop member and disposed within said notch, said fixed projection comprising a post of fixed length disposed within said notch throughout the full range of floating shear plate positions, f. said stop member including an inner transverse planular portion comprising inner and outer concentric rings which are joined together, g. said post extending from said outer ring.

* * * * *